US005397121A

United States Patent [19]

Gipson et al.

[11] Patent Number: 5,397,121

[45] Date of Patent: Mar. 14, 1995

[54] VISUAL SWING AID FOR GOLFERS

[76] Inventors: John S. Gipson, 3704 S. Freeway, Ft. Worth, Tex. 76110; Don M. Wilkerson, #5 Windmill Acres, Cleburne, Tex. 76031

[21] Appl. No.: 32,316

[22] Filed: Mar. 17, 1993

[51] Int. Cl.[6] ..... A63B 69/36

[52] U.S. Cl. ..... 273/487.2; 273/187 R; 273/DIG. 30; 273/187.6

[58] Field of Search ..... 273/187.2, 191 R, 191 A, 273/191 B, 192, 187.6, DIG. 30

[56] References Cited

U.S. PATENT DOCUMENTS

| | | | |
|---|---|---|---|
| 1,591,523 | 7/1926 | Fuller | 273/188 R |
| 1,591,524 | 7/1926 | Fuller | 273/188 R |
| 1,669,457 | 5/1928 | Dailey | 273/188 R |
| 3,215,438 | 11/1965 | Sheldon et al. | 273/188 R |
| 3,368,817 | 2/1968 | Duncan | 273/188 R |
| 3,940,144 | 2/1976 | Dickie | 273/188 R X |
| 4,079,940 | 3/1978 | Arakaki | 273/187.2 |
| 4,318,546 | 3/1982 | Chen | 273/188 R |
| 4,583,740 | 4/1986 | Ohly | 273/191 A |
| 4,762,325 | 8/1988 | McCleery | 273/187.2 |
| 4,789,159 | 12/1988 | Kane | 273/187.2 |
| 4,817,954 | 4/1989 | Kubo | 273/191 R X |
| 4,880,240 | 11/1989 | Lewis | 273/192 X |
| 4,883,126 | 11/1989 | Brown | 273/191 R |
| 4,919,432 | 4/1990 | Coggins et al. | 273/187 R X |
| 4,948,142 | 8/1990 | Taber | 273/188 R X |
| 4,993,716 | 2/1991 | Waller | 273/188 R X |
| 5,013,044 | 5/1991 | Hasselbart | 273/191 R X |
| 5,050,885 | 9/1991 | Ballard et al. | 273/188 R X |
| 5,125,663 | 6/1992 | Lurowist, Jr. | 273/188 R X |
| 5,152,532 | 10/1992 | Rouse | 273/187.2 |
| 5,156,399 | 10/1992 | Gauer | 273/187.2 |
| 5,294,126 | 3/1994 | Armstrong | 273/187.2 |

*Primary Examiner*—George J. Marlo

[57] ABSTRACT

This visual swing aid invention is a body-attaching logical self-instructional device that helps a golfer rapidly develop his or her own unique individual satisfactory golf swing. By using one's own eyes with this device, it helps a golfer ascertain for oneself which backswing and forward swing movements are desirable.

It is a body-attaching device that protrudes outward when fastened to the front centerline of a golfer' body during use. In a preferred embodiment it comprises: a means for consistent positioning with the body, several visible outward from the body indicators, a target line indicator, a bubble level element, a through-hole, a lightweight removeable rod, and a removeable connecting stem.

Each element is located appropriately so a golfer during use can see each one while in an address position or during a backswing or on completion of a forward swing.

It is an aid to body alignment with a ball. It helps body address posture. It helps to align club, clubhead, hips, shoulders, and feet of a golfer simultaneously and consistently at an intended target. It helps with consistent balanced body rotation during an entire swing. It is a simple, safe, lightweight, convenient, and inexpensive device, useable for swings during on-the-course play. It is also very useful without a club for practicing quick drill type body rotation and body balance exercises almost anywhere.

6 Claims, 4 Drawing Sheets

VISUAL SWING AID FOR GOLFERS

FIELD OF THE INVENTION

This invention relates to a golf swing, specifically to improving the backward and forward swing of a golfer, improving alignment toward intended target, and improving address posture.

BACKGROUND OF THE INVENTION

Upon examining the game of golf, it is apparent the real challenge of golf is consistency, both in score and in striking the ball as desired. To develop a consistently desirable golf swing, it is important to have a technique for avoiding undesirable changes; a technique of identifying and adjusting unintentional swing variations as they occur.

In respect to alignment at an intended target, prior art contains numerous devices which help eliminate unintentional variations. But prior art is directed toward only part of the alignment task. For example, several patents are directed toward position of feet and ball relative to an intended target line. A number of patents are directed toward specific body parts, such as shoulders, legs, or hands. But none include a simple device for aligning shoulders, body, feet, hands and golf club at an intended target simultaneously.

Furthermore, for a device to be truly useful, it needs to be useable while a golfer is holding a club in an address position for hitting a ball. Much of prior art is not. Also, several devices shown in prior art are relatively cumbersome to use, they are actually practical to use in practice sessions only. Several devices even prohibit a golfer from safely swinging a club during use. For example, the device in U.S. Pat. No. 4,993,716 to Waller in February 1991, requires a golfer during use to step away it and remember the desired position of alignment. Even short time memory is deceptive and not precise. U.S. Pat. No. 5,013,044 to Hesselbart in May 1991, has adjustable alignment bars, but is directed to foot alignment and controlling swing path of clubhead.

The position of the entire golfer, body and limbs, while holding a club in an address position for hitting a ball usually is referred to as address posture. It also influences the alignment process. Since a swing starts from an address posture, it is obvious a golfer needs a consistent address posture to develop a repeatable consistent swing. Prior art associated with improving and maintaining consistent address posture contains devices which help, such as U.S. Pat. No. 4,993,716 to Waller in February 1991 which is impractical to swing while engaged and U.S. Pat. No. 4,318,546 to Chen in 1982, with straps holding a golfer in desired address posture, but it is too restrictive and does not include distance between body and ball.

After a golfer completes the alignment tasks, with associate address posture, a golfer makes a swing. It is apparent, anyone can swing in any manner for a single swing and achieve perfect results. A hole in one is an example. Such a perfect result has been made by a multitude of golfers with a large number of entirely different swings. This fact alone implies good results for a single swing have little significance in developing a golf swing. The criteria for developing a desirable golf swing is CONSISTENT RESULTS rather than an infrequent perfect result.

Examining prior art associated with golf swings indicates some useful devices and techniques are available.

Much the same as in the alignment task, when developing a golf swing, it is important to have a technique of identifying preferred swing adjustments. And also, a technique for avoiding or eliminating undesirable swing changes.

Several patents are involved with arm position during a swing. U.S. Pat. Nos. 1,591,523 and 1,591,524 to Fuller in 1926 are arm guide swing devices. While they attach to the body in an interesting manner, the modern golf swing is much more than an arm swing. Other art is involved with shoulder positions during a swing. Some pertain to head position. Some such as U.S. Pat. No. 5,013,044 to Hesselbart in May 1991 and U.S. Pat. No. 4,919,432 to Coggins et al. in April 1990 are directed to controlling path of clubhead during a swing. Controlling the path of the clubhead can produce undesirable body and muscle movements.

Several involve restricting leg actions or movements during a swing. U.S. Pat. No. 5,050,885 to Ballard in September 1991 is a rotating machine that attaches to a golfer to help force the desired rotation of hips and shoulders. Although the rotation may be desirable, not everyones' body parts rotate the same and the size of the device is cumbersome. U.S. Pat. No. 5,125,663 to Lurowist, Jr. in January 1992 is a seat type device to help with posture and rotation, but is very restrictive. U.S. Pat. No. 4,948,142 to Tabor in August 1990 is a swing control limiter pertaining to hips and neck movements. Such devices make it difficult to make a natural swing. U.S. Pat. No. 3,215,438 to Sheldon and Levinson in November 1965 is directed to hip movements which are only part of the golf swing.

U.S. Pat. No. 3,940,144 to Dickie in February 1976 attaches to the belt of a golfer to limit weight shift during a swing. But a golf swing is more than weight shift. U.S. Pat. No. 4,817,954 to Kubo in April 1989 is a harness type device to assure a consistent backswing position for the club but ignores body position.

U.S. Pat. No. 3,368,817 to Duncan in February 1968 is concerned with body action during a swing. It attaches to the waist area and emits a click for specific rhythmic actions during a swing. It is interesting but is lacking in considering proper rotation and balance.

U.S. Pat. No. 4,583,740 to Ohly in April 1986 is directed toward developing muscles associated with a circular swing. It is too restrictive and nothing helps develop the proper muscles better than repetitive desirable swings.

U.S. Pat. No. 1,669,457 to Dailey in May 1928 is a combination guide, gauging and timing device. It is lacking for it does not include swing balance.

Much of prior art involving golf swings is directed toward developing one swing objective. Some are useful for practice situations only. Several devices attempt to force a golfer to move his or her body in a prescribed manner with restrictive straps or other devices. Many are very cumbersome to use. Some are complex and expensive.

Some of prior art attempts to help a golfer from a very desirable perspective; seeing oneself during a swing. Some even use a mirror, positioned to facilitate seeing one's own swing. The need for an unbiased, consistent, reliable technique of seeing one's own golf swing is obviously great. This is indicated daily by the large numbers of golfers and golf instructors using video devices and cameras for this purpose. A video camera helps in viewing completed swings, but it is difficult to use to advantage during an actual swing. It is basically a visual aid after the fact. Usually even with video devices, an expensive instructor is needed to indicate the desired swing positions and body movements. It is also difficult for a golfer to convert desired movements into actual movements by viewing pictures. Actually, a golfer already has a good video device, his or her own eyes, which can be used to view his or her own swing as it occurs.

Furthermore, a golfer needs to actually 'feel' for oneself the desired movements and positions, preferable either during a swing or at least immediately prior to a swing. Some of prior art involves devices from this 'feels' perspective. But these also are lacking. They often relate to a single 'feel' or some muscle activity similar to the ones involved in a golf swing. Nothing 'feels' exactly the same or is as convincing as the 'feels' of the entire swing itself.

Also, none of prior art satisfactorily incorporates the interaction between body configuration and preferred golf swing. Some consider height, weight, and shape of torso a little, but little consideration is given to the real differences between golfers concerning natural body movements and muscle control. Thus, for a golfer with limited body flexibility or a particular body configuration, they are unsatisfactory. Also, the natural limb movements or control of muscles of a golfer many not respond well to a prescribed swing path or movement. None of prior art are entirely satisfactory for developing a consistent repeatable satisfactory golf swing. This is exemplified by the large amounts of money golfers spend for instructors and aids to help them improve their golf swing. In general, the instructors and golfers are less than satisfied with the results. Few achieve their goals and then only after many hours of practice and expensive instruction. It is apparent, 'A GOLF SWING NEEDS TO BE CUSTOMIZED TO THE INDIVIDUAL GOLFER.'

The full impact of this statement is generally missed by golfers, both novice and professional. Most people, golfers too, enjoy items uniquely developed or made for them. Nearly everyone performs better when they contribute directly to a project. The golf swing of a golfer is more consistent and desirable if it is uniquely their own. Especially, if it is mostly self-developed. This could explain why top professionals have unique swings. Their swings are mostly self-developed with help from others occasionally to overcome a specific difficulty.

Each golfer needs to develop his or her own individual customized repeatable consistent golf swing. In many respects, this is an entirely new concept to the golfing world, even though the t professionals have essentially done something similar, continuously. Nearly all professional golf instructors recognize that each golfer needs to individualize some minor items, but they usually teach a preferred personal basic swing technique; one they have either playing or teaching experienced success with.

Briefly, there exists a need for a self-instructional swing aid device for a golfer to develop his or her own unique individual golf swing; a golf swing customized to what his or her body configuration will accommodate as he or she rotates. One that helps a golfer in whatever manner his or her body moves easiest or best under normal self-control of muscles to execute a rotational golf swing. To ascertain for oneself when rotational movements are satisfactory and repeatable enough to produce consistently predictable effects on a golf ball when hit. It naturally is desirable to know when body rotations and movements are equivalent to previous ones. With consistent address posture, backswing, and forward swing body rotations and movements, a golfer develops muscle and body 'feels' rapidly and decreases swing development time considerably.

The swing aid invention device presented herein is a simple, safe lightweight, convenient, and inexpensive device, which fulfills these needs and helps a golfer develop a consistent satisfactory golf swing. It is also useable for swings during on-the-course play as well as during practice swings elsewhere.

SUMMARY OF THE INVENTION

This visual swing aid invention device is a self-teaching device that attaches to the body of a golfer during use. It may be attached to the body in several ways. It can be inserted between belt and body or preferredly secured by belt or elastic type strap near the waist. Wherever attached for use, it protrudes outward from the body and in a preferred embodiment comprises the following elements:

(1) a positioning indicator for aligning device to the front centerline of the body of a golfer,
(2) a visible outward from the body indicator which is perpendicular to the body of a golfer when attached appropriately during use,
(3) other visible outward from the body indicators parallel to the outward from the body indicator,
(4) a visible target line indicator perpendicular to the outward from the body indicator,
(5) a visible bubble level element aligned parallel with the visible target line indicator,
(6) an easily removeable lightweight rod element that is easily secured to the protruding element parallel to the visible target line indicator,
(7) a through-hole near the outward from the body indicator,
(8) an easily connected and disconnected angularly adjustable and length adjustable stem element.

Each element and indicator is located appropriately so that when invention device is attached properly, a golfer can see each one while in an address position or during a backswing pause or on completion of the forward follow-through swing with a golf club.

This swing aid invention device fulfills some definite needs associated with developing a good golf swing; it is an aid to consistent alignment at intended target, consistent address body posture, consistent amount of rotation of the upper body or breast bone, consistent amount of rotation of the lower body or hips, and consistent level rotation of the hips.

Furthermore, it is a simple, safe, lightweight, convenient, and inexpensive device. It is useable during on-the-course play as well as during practice sessions elsewhere. Even more importantly, by using one's own eyes appropriately with this visual swing aid invention device, it is a self-instructional device which enables a golfer to ascertain for his or her self when the desired body rotations and movements are satisfactory during a swing.

An object of the invention is to provide a swing aid device which promotes consistent alignment toward intended target.

An object of the invention is to provide a swing aid device which promotes a consistent satisfactory entire swing, a consistent satisfactory backswing and a consistent satisfactory forward swing.

An object of the invention is to provide a swing aid device which promotes a consistent address posture.

An object of the invention is to provide a device that is of simple construction and reliably indicates to a golfer the needed information to become his or her own swing instructor with confidence in the swing evaluations.

Another object of the invention is to provide a device that promotes a consistent technique of self-evaluating and self-adjusting one's own body movements and balance throughout the swing, especially at points of pause during a swing.

Another object of the invention is to provide a device that is safe to use during actual golf swings, both for on-the-course swings and practice swings.

A further object of the invention is to provide a device that is useable for repetitive practice swing drills without ball or club, indoor or outdoor, to help develop swing 'feels'.

Still another object of the invention is to provide a device that is small, light-weight, easily and readily carried by a golfer for use at his or her convenience.

Still another object of the invention is to provide a device that is easily and quickly attached for use or removed from use in seconds.

Still another object of the invention is to provide a device that easily adjusts to different physical body configurations.

Another object of the invention is to provide a device that can be used equally well by right handed and left handed golfers.

These and other objects, desirable characteristics and advantages of the invention will become more readily apparent from the following referenced drawings, detailed description and claims.

Reference numerals for drawings

20—Visual swing aid device
22—body engaging element
24—protruding element
26—alignment positioning indicator
28—perpendicular to body indicator
30—outward from the body indicator
32—mating material on outward from the body indicator
34—outward from the body indicator
36—mating material on outward from the body indicator
38—outward from the body indicator
40—mating material on outward from the body indicator
42—outward from the body indicator
44—mating material on outward from the body indicator
46—outward from the body indicator
48—mating material on outward from the body indicator
50—visible target line indicator
60—bubble level element
62—holder for bubble level element
64—holder for bubble level element
66—level mark of bubble level
68—level mark of bubble level
70—through-hole
72—attaching part of stem element
74—length adjusting part of stem element
76—stem element
80—front centerline of a golfer's body
82—lightweight removeable rod
84—holder for removeable rod
86—holder for removeable rod
87—knob near one end of removeable rod
88—handle of golf club
90—shaft of golf club
92—clubhead of golf club
94—shoe of golfer
96—instep of shoe of golfer

DETAILED DESCRIPTION OF INVENTION

One of the interesting aspects of this body attaching visual swing aid invention device is that it provides a method of visually self-measuring body movements and positions. The measurements are sufficiently accurate for developing a consistent golf swing. Since the device includes a procedure of positioning and attaching to the body of a golfer in a reliable consistent manner, it provides repeatable consistent visual measurements continuously. This invention device clearly uses the eyes in many interesting ways to help a golfer develop a consistent repeatable satisfactory golf swing.

This swing aid invention device helps a golfer in several ways. The quick easy technique shown by which a golfer can develop and improve his or her own customized golf swing using the invention device describe herein is completely new. It helps a golfer rapidly develop his or her own consistent golf swing, mostly without help from others.

It is an aid to target alignment and address posture. This device helps a golfer align club, hips, shoulders, and feet simultaneously and consistently toward an intended target while holding a club in an address position. It helps a golfer self-develop his or her own individual customized desirable backswing and forward swing.

This discussion begins with a complete detailed description of a preferred embodiment of this invention device with its elements. Followed next by methods of using it appropriately and concludes with some of its more apparent advantages.

Figure 1:
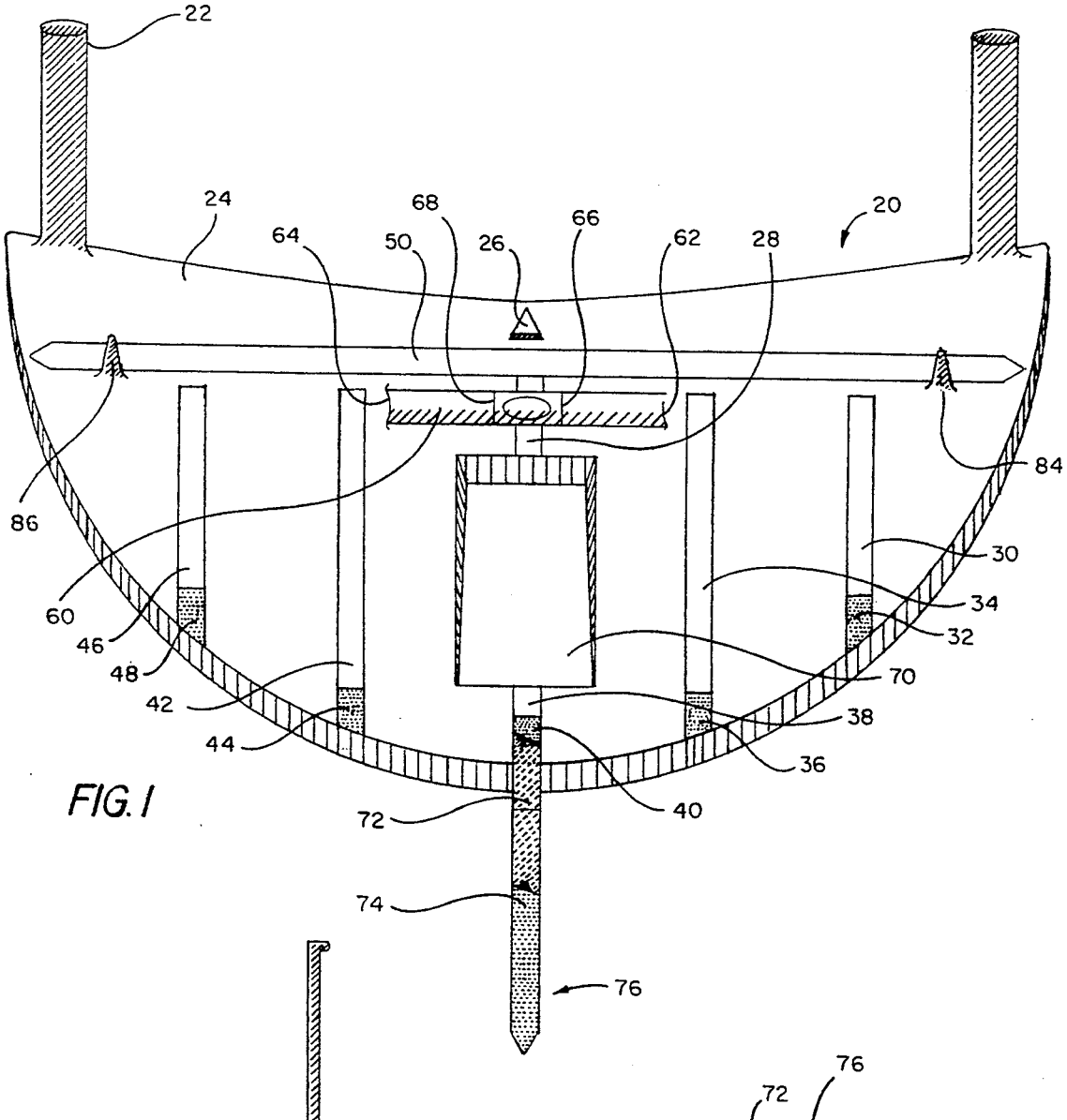
FIG. 1 shows a preferred embodiment of the visual swing aid invention device.

Turning now to FIG. 1, which illustrates a preferred embodiment form of this visual swing aid invention device. The general device is denoted by 20. It includes a body engaging part 22 of an outwardly protruding element 24. It also contains a body alignment positioning indicator 26 for aligning device 20 appropriately with the front centerline of the body of a golfer.

Several outward from the body indicators 30, 34, 38, 42, 46 are shown with mating materials 32, 36, 40, 44, 48 near their respective ends opposite the body engaging member 22.

In this embodiment, Indicator 38 is shown linearly aligned with the positioning indicator 26 and a perpendicular to body indicator 28. The other indicators, 34 thru 46 are shown parallel indicator 38. Other non-linear, non-parallel arrangements of these indicators yields other desirable embodiments of this device.

A visible target line indicator 50 extends the length of protruding element 24 and is perpendicular to indicator 28 and indicator 38. This embodiment uses the square to intended target alignment technique, but device 20 is readily adjustable to other target alignment techniques by simply making multiple target line indicators adjacent to indicator 50 at desired angles with respect to indicator 28.

A bubble level 60 is secured to protruding element 24 by level holders 62 and 64. Level 60 is positioned perpendicular to indicator 28 and in this square to target embodiment is parallel to the target indicator 50. It is important each level mark 66 and 68 as well as all the other indicators be visible during use.

Through-hole 70 is a simple hole completely through device 20 sufficiently large to be used for sighting ground objects when device 20 is attached for use near the waist. As shown, it is desirable for through-hole 70 to be in close proximity to indicator 38.

As illustrated, a long stem 76 is formed by mating two pieces 72 and 74 of flexible mating material with each other. Piece 72 is also easily mated with mating material 40 near the end of indicator 38 as shown. The mating material used in 72 and 74 to form stem 76, needs to be sufficiently rigid so that after 72 is also mated with 40, stem 76 extends generally linearly outward from indicator 38 with only a small angle downward. The length of stem 76 is easily adjusted as desired by two procedures. First, piece 74 is mated to piece 72 by overlap mating of 72 and 74 as much as practical. Second, piece 74 is long and after the overlap mating, piece 74 is easily cut a desired customized length for an individual golfer.

As the other indicators 34 thru 46, have the same type of mating material near their respective ends, piece 72 of stem 76 mates equally well with each.

In regard to materials, it is helpful that body-engaging element 22 not be extremely rigid. It is desirable the entire device 20 be made of pliable, malleable material but sufficiently rigid to remain in place during use. Of course, it also needs to have enough rigidity to support the lightweight elements it supports. The protruding element 24 needs to extend outward from the body far enough for all the indicators to be visible during use, but no farther than necessary so that the likelihood of engaging during a swing is minimal. For additional safety during use, it is also beneficial for protruding element 24 to have horizontally curving rounded blunt edges. This helps assure no harm occurs should it accidentally be engaged by hands or arms during a swing.

Figure 1A:
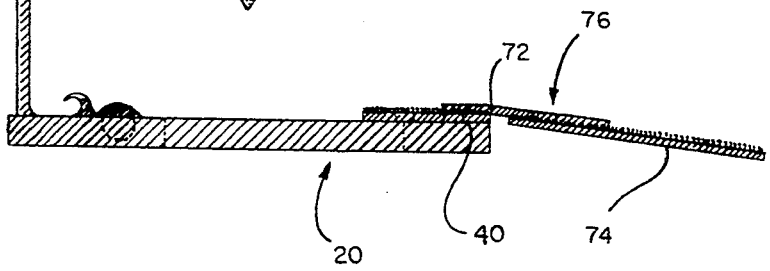
FIG. 1A is a cross sectional view of the visual swing aid device.

Referring now to FIG. 1A. It is a horizontal cross-sectional view of swing aid invention device 20. It further illustrates the mating of 72 and 74 to form the stem 76. Also, the mating of 72 to mating material 40 is easily seen.

Figure 2:
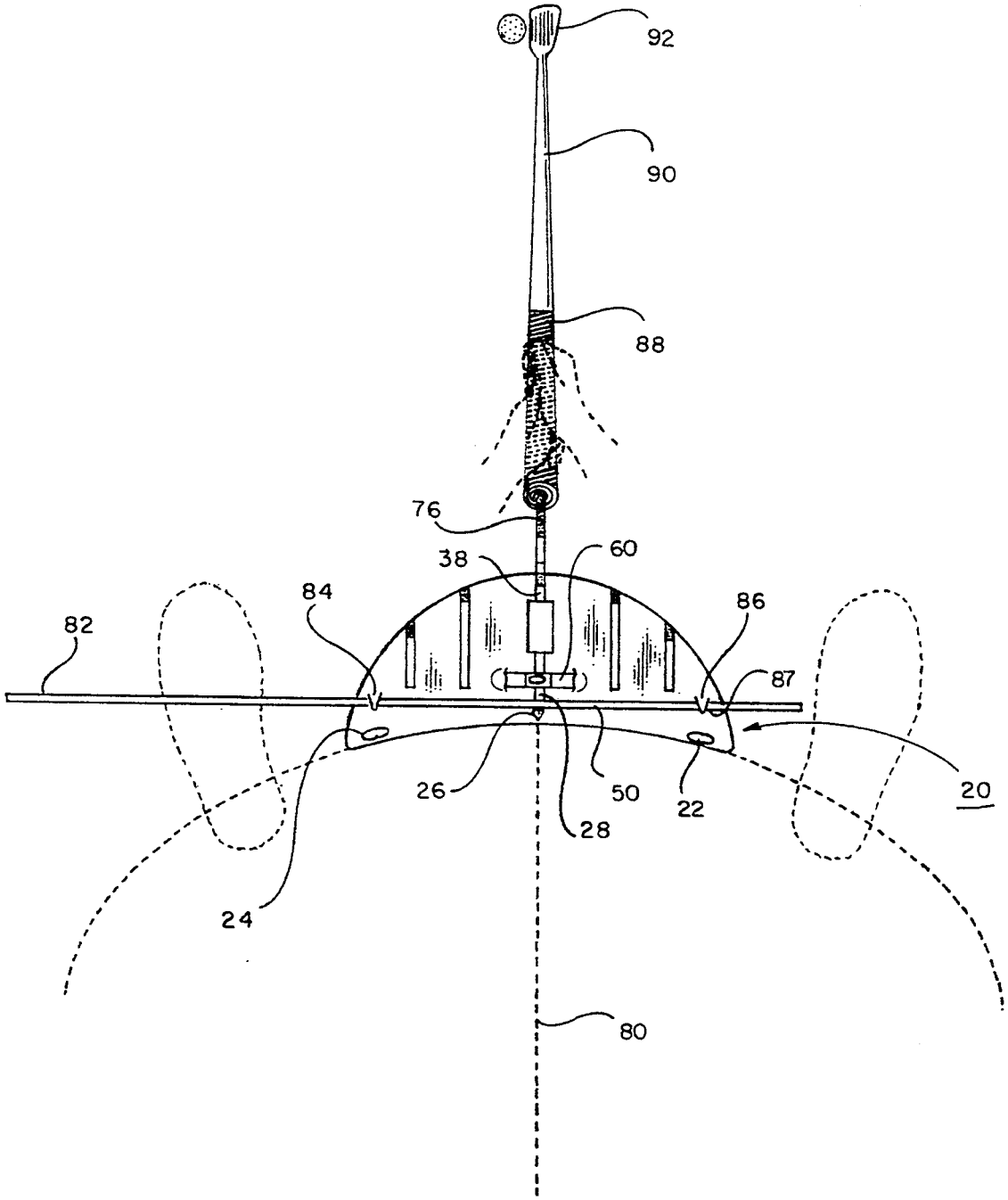
FIG. 2 is view of invention device as seen by a golfer with swing aid invention device attached for use near the waist with the golfer holding a golf club in an aligned address position.

Only one element of this swing aid invention device is not shown in FIG. 1. It is shown in FIG. 2. In this figure, illustrating the view a golfer sees in an address posture with invention device 20 attached for use near the waist, all the elements of device 20 are visible to a golfer, easily distinguished and readily useable by the golfer for the alignment task. Also, illustrated is the last element of this invention device, a lightweight removeable rod element 82. As illustrated, It is held in place by two semi-loop shaped holders 84 and 86 of protruding element 24. Holders 84 and 86 are aligned parallel to target indicator 50 and permit rod 82 to be extended considerably in the same direction as the target indicator 50. As holders 84 and 86 are not closed loops, they permit rod 82 to be easily removed by sliding rod 82 toward body engaging element 22. A reverse action makes rod 82 equally easy to place in holders 84 and 86. Once in the holders, rod 82 is easily extended in the direction of target indicator 50 until knob 87 near the end of rod 82 prohibits farther extension. As shown in this figure, knob 87 engages holder 86 and stops farther extension of rod 82.

In respect to using device 20 properly, it is quickly and easily attached for use in a few seconds. A golfer only needs to stand erect, fasten device 20 with a belt or strap to his or her body. Next adjust device 20 so that positioning indicator 26 is aligned with the front centerline 80 of his or her body. Next, adjust device 20 horizontally, until bubble level 60 indicates protruding element 24 is level. Now it is ready for use. Most often it is fastened to the body for use near the waist with a belt or elastic type strap. Or alternately, it can be fastened very quickly for use by simply slipping between a golfers' belt and body. Disuse is simple and quick, just ignore it. It is safe to swing with it secured in place; or a golfer can quickly detach it from the body completely.

Now attention is directed to using device 20 appropriately as an aid to alignment both with respect to a ball and an intended target. One of the difficulties of alignment is determining the alignment of one's own shoulders and body while in an address posture. For consistent satisfactory target alignment, a golfer definitely needs to know the alignment of his or her own body parts relative to the golf ball and relative to an intended target while in an address posture.

FIG. 2 helps understand the aid this invention device 20 provides to the alignment difficulties mentioned. FIG. 2 illustrating a golfer's view in address posture during use of device 20, shows each of the following are linearly aligned:

a clubhead 92,
a shaft of the club 90,
a handle of the golf club 88,
the stem element 76,
the outward from the body indicator 38,
the perpendicular to the body indicator 28,
the positioning indicator 26,
the front centerline 80 of the body of the golfer.

This linear alignment arrangement using device 20 only requires using the eyes in a line of sight manner appropriately. With device 20, a golfer can consistently align the clubhead, club, and his or her body the same so that alignment variations in the address position relative to the ball are minimal. The address alignment position illustrated in FIG. 2 is appropriate for shorter distance clubs. Similarly, the same components of a golf club can be readily aligned with the other outward from the body indicators. These indicators are useful for other clubs. As is apparent, rod 82 can be extended equally easy in the opposite direction for left handed golfers.

In respect to aligning at an intended target, various techniques concerning body, foot position, and etc. relative to intended target are used. For this discussion with this embodiment of the invention device 20, the square to intended target technique is used.

Referring again to FIG. 2 the visual target indicator 50 is illustrated perpendicular to the linear address alignment arrangement with the golf ball. Indicator 50 provides a golfer with a definite perpendicular line to help visually align toward an intended target while in the address posture. Also, as shown in FIG. 2, the easily removeable lightweight extended rod 82 provides a visibly much longer temporary target line indicator to facilitate aligning toward an intended target. As shown, rod 82 is parallel to and extends in the same direction as the target indicator 50. Also, rod 82 is readily available and useful as a sighting instrument to align the position of the feet as desired toward the target. In this figure, the feet are also aligned square with the intended target. Once alignment is complete, rod 82 in semi-loop shaped holders 84 and 86 is easily slipped out its holders with one hand and dropped aside while maintaining alignment and address posture. Now a swing can be safely made with no change in target alignment or address posture. As is apparent in this figure, rod 82, provides a much longer indicator for intended target direction alignment. With experience indicator 50 alone is satisfactory for aligning toward an intended target, but during initial use of device 20, rod 82 is very helpful in improving alignment performance.

With address alignment variations associated with ball reduced, and using indicator 50 together with rod 82 to minimize target line variations, alignment toward an intended target is improved and consistently repeatable. Also, due to the manner in which device 20 is fastened in aligned position to the body of a golfer, the body and hips of a golfer are aligned satisfactory in respect to the ball and the intended target. Fastening device 20 to the breast bone or sternum, and visually aligning indicator 38 with the ball and indicator 50 to intended target aligns the shoulders similarly satisfactory also. Obviously, device 20 improves alignment when fastened both at the sternum and near the waist properly. Fastening two such devices is practical, since this is a very inexpensive device.

Briefly, summarizing device 20 alignment aids. It helps align club, hips, shoulders, and feet simultaneously and consistently relative to a ball and relative to an intended target while holding a club in an address position. It:

- improves golf club and clubhead alignment consistency relative to body and an intended target,
- improves hip alignment consistency relative to a golf ball and an intended target,
- improves shoulder alignment consistency relative to a golf ball and an intended target,
- improves foot alignment consistency relative to a golf ball and an intended target,
- improves alignment consistency toward the intended target line,
- reduces all unconscious alignment variations, especially ones resulting from looking in an intended target direction.

These results indicate device 20 used appropriately is a definite alignment aid.

After a golfer completes the alignment tasks, his or her next task is to make a consistent swing that hits the ball in a desirable manner. Device 20 when used properly, helps a golfer rapidly develop a consistent repeatable rotational golf swing with good vertical balance. It is most beneficial in developing a circular golf swing, produced by shoulder and body rotational motions. But it is also useful in developing golf swings with lateral shifts back and forth as some golfers do with skill. It helps in developing a consistent amount of shift.

For a circular swing the swing center needs to rotate a consistent amount. The swing center is located midway between the shoulders and directly behind the sternum at shoulder level. The sternum is very close to this swing center and in general, indicates the amount of rotation of the swing center.

A golf swing actually consists of two swings, a backswing and a forward swing. The main purpose of the backswing is to set the club in a desirable same position to strike the ball consistently the same on the forward swing. To make the same amount of rotational backswing and set the club in the same or equivalent position is not easy. Device 20 is a definite aid to a consistent backswing.

Figure 3:
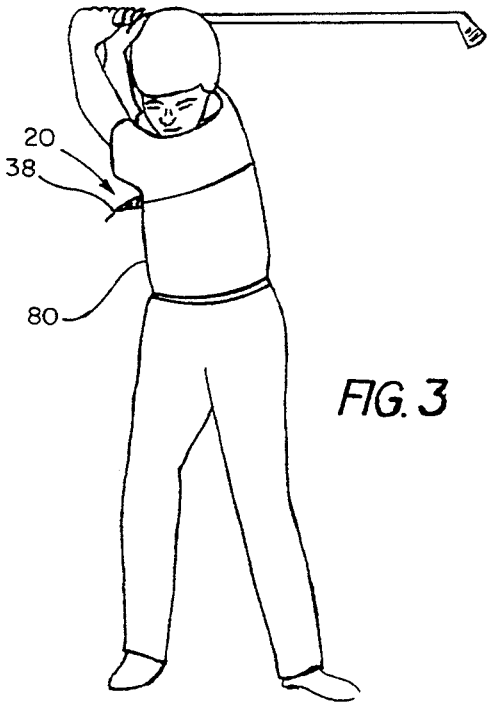
FIG. 3 is a view of a golfer at pause point of a backswing from a perspective standing near the golf ball, with invention device attached for use at the breast bone of a golfer.

Device 20 is easily secured and aligned with the front centerline 80 of a golfer at the sternum by an elastic type strap as illustrated in FIG. 3. In the illustrated backswing position of this figure, a golfer using device 20 can actually pause and view the amount his or her sternum has rotated relative to the address position or relative to an intended target line.

Furthermore, when device 20 is fastened properly at any point on the front centerline 80 of a golfers' body, indicator 38 is perpendicular to the body. A golfer needs to only look in the direction indicated by indicator 38 to see even more precisely the amount of rotation of the sternum or shoulders. Also, as the ball is struck on the forward swing only, a golfer can actually pause and adjust his or her body movements until the desired amount of rotation is achieved before starting the forward swing. Pausing and adjusting is somewhat awkward, but doing so provides a golfer immediately with the muscle 'feels' and body 'feels' associated with a consistent amount of shoulder rotation. In addition, a consistent amount of shoulder rotation can be practiced repeatably without a club in successive drill type backward and forward rotations which facilitates developing the desired amount of habitual rotation.

Figure 4:
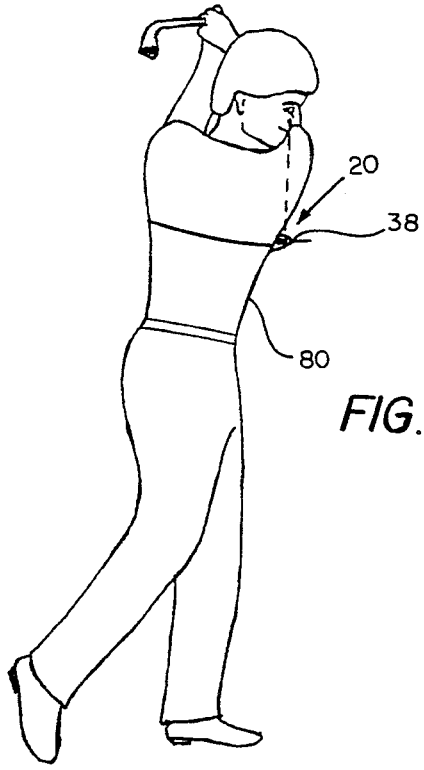
FIG. 4 is a view of a golfer at finish of forward swing from a perspective standing near where golf ball was hit with invention device attached for use at the breast bone of a golfer.

Similarly, FIG. 4 illustrates a golfer on completion of a forward swing with device 20 fastened to the front centerline 80 of the body at the sternum. As is apparent, the amount of shoulder rotation for the forward swing is also easily determined by the golfer. Again for a precise indication, a golfer only needs to look in the direction indicated by indicator 38 on completion of the forward swing.

Figure 5:
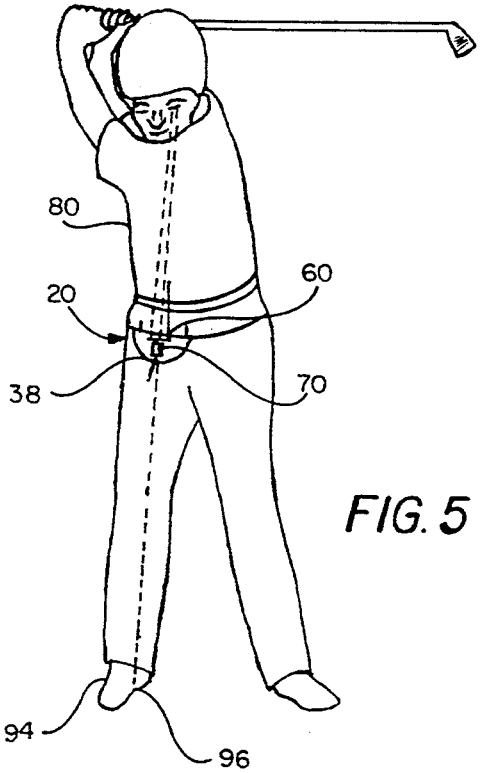
FIG. 5 is a view of a golfer at pause point of a backswing from a perspective standing near the golf ball, with invention device attached for use near the waist of a golfer.

Another task a golfer performs during a rotational backswing is rotating the lower body or hips a consistent amount. FIG. 5 illustrates a golfer at the end of a backswing with device 20 fastened for use on the front body centerline 80 near the waist. At this point a golfer using this swing aid can actually pause and visually evaluate the backswing, especially during practice swings.

A golfer can see indicator 38 and ascertain the amount his or her hips have rotated. For consistency, the amount is easily related to address position or an intended target line extended backward or to visual proximity of foot farthest from target. The desired amount of hip rotation for a backswing is generally less than for the shoulders.

A golfer can also view the bubble in level 60 during a backswing pause and determine levelness of the lower body, relative to ball direction. Preferably level, but if not, could achieve increased swing consistency by bubble being unlevel in the same position each swing. Also, a golfer can adjust legs, hips, etc. until level 60 indicates level. This adjustment technique helps a golfer 'feel' immediately a level hip position. Since the bubble level 60 is a known reliable mechanical instrument, subjective evaluations by others concerning levelness of the hips are unnecessary.

Also, while a golfer is in a backswing pause position as shown in FIG. 5, he or she can sight through the through-hole 70 and see ground objects. For consistent lateral vertical balance in the target line direction, a golfer looking through the through-hole 70 needs to consistently see the same spot on his or her shoe 94; preferably, a spot 96 near his or her shoe instep. Again, a golfer can adjust hips, legs, etc. vertically until the same desired spot 96 is in view. This indicates his or her lateral vertical movement or balance is consistent.

All of these adjustments at the end of the backswing help a golfer 'feel' immediately his or her desired body position for consistent hip rotation and vertical balance. During practice swings, it is helpful a backswing be made slowly and a golfer adjust movements as he or she swings backward to 'feel' the desired body actions or movements for consistently satisfactory hip rotation and vertical balance. Furthermore, since the ball is hit only on a forward swing and there is no rule against a pause at the end of a backswing, a golfer can actually pause and make the desired adjustments before initiating the forward swing. Such a procedure is slightly awkward at first, but with practice and reduced pause time, it helps a golfer 'feel' immediately, consistent satisfactory positions. Obviously, used in this manner, device 20, is definitely a self-instructional backswing aid.

Figure 6:
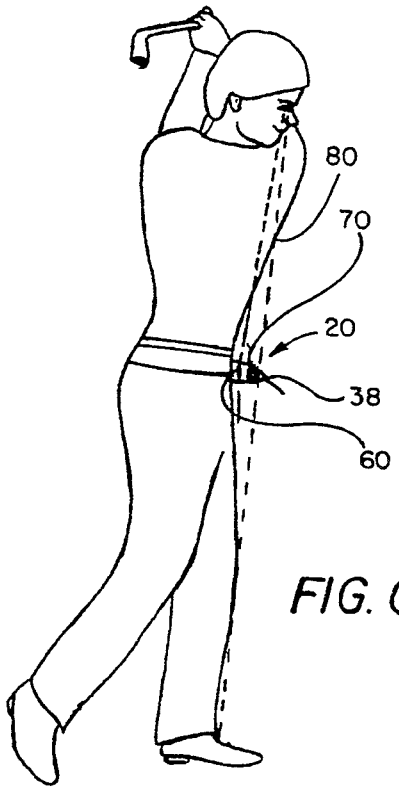
FIG. 6 is a view of a golfer at finish of a forward swing from a perspective standing near where golf ball was hit with invention device attached for use near the waist of a golfer.

Now turning to FIG. 6 which illustrates a golfer on completion of a forward swing with device 20 fastened to the front centerline 80 of the body near the waist. As is apparent, the amount of hip rotation for the forward swing is also easily determined by the golfer. Again for a precise indication, a golfer only needs to look in the direction indicated by indicator 38 on completion of the forward swing. For a consistent forward swing, the hips need to rotate until the front centerline 80 is aligned with intended target line.

Similarly, using device 20, vertical balance on completion of a forward swing is easily determined. In FIG. 6, it is apparent a golfer on completion of the forward swing can view the bubble level 60 and sight through the through-hole 70 similarly as during the backswing pause. Adjustments on completion of a forward swing can only provide a golfer with a 'feel' for the desired position at completion of a forward swing, not during the swing. In a very slow motion forward swing, a golfer can actually adjust his or her body actions or movements during such a slow motion swing and maintain satisfactory vertical balance. This technique helps a golfer 'feel' the desired body actions or movements to maintain vertical levelness during a forward swing. A golfer naturally can't strike a golf ball in slow motion to any advantage, but he or she can definitely 'feel' the desired body movements and positions. Once again, used in this manner, device 20, is definite a self-instructional swing aid that helps a golfer develop his or her own consistent forward swing.

To develop a golf swing rapidly, muscle and body movements and 'feels' are very important. Only by consistently repeating satisfactory and desirable equivalent movements and body positions is 'swing feel' or 'muscle memory' developed properly. The less time between desirable 'swing feels' the more rapidly a repeatable swing develops. Using visual swing aid device 20 appropriately, at points of pause during a swing, and in a slow motion fashion as discussed, desirable consistent 'swing feels' are constantly accessible to a golfer. In practice sessions, the desirable 'swing feels' are easily experienced during a swing by adjusting body positions appropriately. This helps a golfer immediately experience and perform the desired adjustments to body movement. This technique helps a golfer develop his or her own individual desirable customized consistent golf swing.

Another significant variable in swing development is address posture; the position from which a golfer starts a back swing. It is very helpful to swing development that address posture be repeatable and consistent as possible. As indicated in the alignment discussion, device 20 helps assure consistent alignment relative to a golf ball and an intended target, but there are also other variables associated with address posture.

The amount of tilt of the upper body toward the ball affects address posture. Tilt variations modify the distance the ball is from the body of a golfer, which in turn modifies consistency of a repeatable swing to strike the ball as desired. Without some method of measuring and checking this tilt, unintentional variations will naturally occur. With the use of device 20 fasten the same and appropriately near the waist, a golfer can measure and keep the distance from his or her body to the ball, consistently the same.

Figure 7:
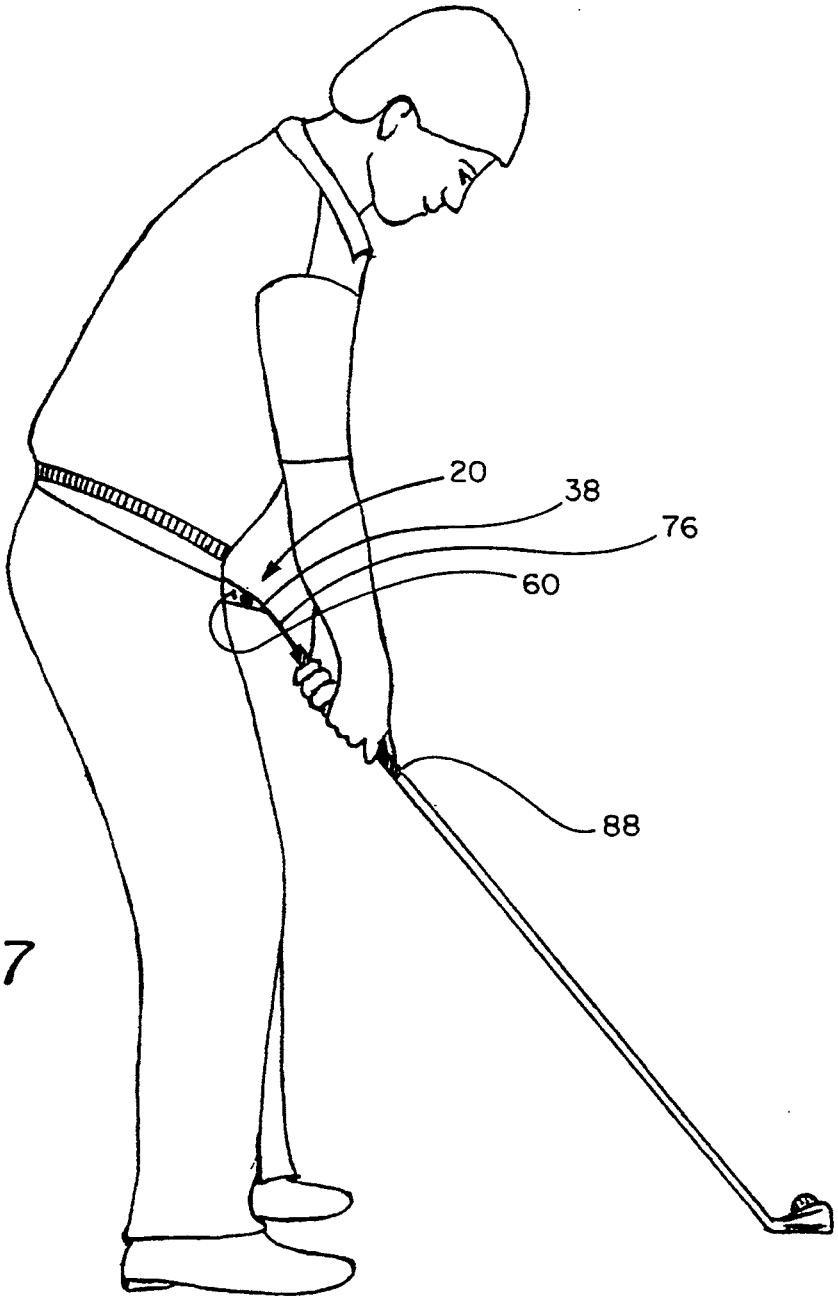
FIG. 7 is a view from behind a golfer in address posture addressing a golf ball for hitting with invention device attached for use near the waist.

FIG. 7 illustrates device 20 fastened to a golfer near the waist while in address posture. It is a view in line with intended target line from behind a golfer addressing a ball. As mentioned previously, stem element 76 is flexible, length adjustable, and connected in alignment with indicator 38. In this figure, stem 76 is bent angularly down and just touches the end of the golf club handle 88 as shown. The distance between the body of a golfer and the ball is accurately and definitely established once the stem length is adjusted as shown. For additional swings with the same club, device 20 helps measure and keep body distance to the ball the same, which in turn, helps upper body posture or tilt remain the same.

Also, since stem element 76 is flexible and connected by mating material 72 to mating material 40, it is safe to swing with stem 76 in place. This makes it practical for a golfer to use device 20 with stem 76 to adjust his or her upper body tilt as needed to maintain same address posture during practice sessions and without any other actions, make actual swings safely. Thus, device 20, using this technique helps eliminate unintentional posture variations between swings.

Furthermore, while in an address posture a golfer can use level 60 to adjust his or her hip positions until level 60 indicates hip levelness in an intended target line direction. The desired level hip rotations of a swing are much more likely to be consistent when initiated from a level hip position. And again, without any other action which might produce unintentional changes, a golfer can actually swing safely with device 20 in place. Reducing any unintentional address posture variations will naturally improve swing consistency.

As indicated throughout this discussion, a unique aspect of this visual swing aid invention device is its self-instructional nature. All measurements performed with the aid of this device are actually self-performed by the golfer. It helps avoid some swing problems by visually indicating the problem to the golfer, immediately. It consistently provides a golfer with self-help from the most needed perspective;

'what a golfer needs to mentally know and the desirable muscle or body adjustments or 'feels' during a swing itself.'

With this device, a golfer can make practice swings and pause as desired during a swing and without assistance from anyone else, ascertain if the position at swing pause is satisfactory and/or equivalent to previous swing positions. If positions at swing pause are not satisfactory, a golfer can see the results of adjustments immediately. A golfer can immediately adjust himself or herself and 'feel' a satisfactory desirable position. It helps one to ascertain for oneself in an unbiased reliable manner satisfactory and consistent body movements and positions. This helps eliminate indecisive thoughts concerning such body movements and positions; thoughts resulting from poor swing results, conflicting advice, or not having swung a club recently. Nothing helps a golfer develop a consistent swing more rapidly than 'feeling' equivalent satisfactory body and muscle positions with each practice swing. It provides a quick direct self-instructional method for developing a desirable customized repeatable consistent golf swing.

It is also worth mentioning that with consistent satisfactory body positions and rotational movements, swing repeatability and consistency is definitely improved. While this may result in an attractive swing path or plane for some golfers, others may not be so appealing due to the body configuration and or flexibility of the golfer. But in either situation, the resulting golf swing provides a golfer with the ability to strike the ball repeatably and consistently satisfactory.

The reliability of this device is significant. It is an unbiased visual swing aid with a bubble level element, which is a known reliable instrument. The visual alignment indicators, target indicator, and through-hole and rod are definitely reliable. Each indicator does require a golfer to use his or her eyes and are only as precise as a golfer so dictates. But with practice, line of sight using the eyes is a consistent reliable measuring technique in any endeavor.

Another variable involved in using the eyes in conjunction with this visual device is one of color. Normally, color has little effect on the operation of a device, but for this visual device it has a definite enhancing effect. During use, a golfer looks down toward the device with grass on the ground as background. Grass varies from green to brown depending on the time of the year. For good visibility, it is helpful the color of this visual device contrast visually with green and brown. It is also important that the visual indicators of the device be easily seen by a golfer, thus their color needs to be visually contrasting with the color of the device. A black, red, or white device with contrasting white, black, or red indicators fulfills both desires for visually contrasting colors. Of course, color is not a necessary element, it simply enhances the device considerably.

Another unusual desirable feature of this device is convenience. For a device that is helpful in so many ways it is unusually lightweight and small. It is easily carried wherever desired and attached or disattached for use in a few seconds. Space requirement needs for use are also minimal, especially when practicing without a club; such as practicing development of some swing 'feels'. Such practice is easy to do almost anywhere; indoors, at office or home, on practice tee, on tee of hole during on the course play, or just prior to executing a golf swing during on the course play. Only sufficient space to rotate the body is necessary to practice quick successively repetitive rotational type backward and forward body rotations. To practice the desired consistent rotations for the shoulders and hips. Or similarly, to practice vertical swing balance in a similar manner. This practice without a club, provides the desired muscle and body position 'feels' associated with consistent swing rotations and consistent vertical balance. Practice exercises definitely enhance muscle and mental memory considerably. Thus, with these type of practice drills a golfer rapidly develops desirable swing movements and habits that quickly translate into consistent repeatable swing 'feels' with minimum effort.

It is even more useful in practice sessions with a club. It helps develop consistent address posture and target alignment by definite repeatable measure of the distance between body and ball. Target alignment consistency is improved by improving body alignment with ball and intended target. It also improves visibility of alignment toward intended target while in the address position. These alignment improvements in practice sessions emphasize real advantages using this device. With a club, it helps throughout the swing in developing a consistent amount of rotation of body parts and vertical swing balance. Such practice consistency inherently helps a golfer with consistent hand, arm, and shoulder positions.

With the aid of this invention device, consistency naturally increases with practice since satisfactory equivalent movements are indicated in an unbiased reliable manner. Such satisfactory movements are indicated independent of elapsed time between swings or other factors which normally have a negative effect on swing development. Thus, practice effort with this device produces definite improvement which makes the game less frustrating and more enjoyable for a golfer.

The foregoing sets forth the invention in its preferred, practical form but it is susceptible to various changes, shapes, modifications and materials without departing from the spirit thereof.

What is claimed is:

1. A body-engaging golf device for attachment to a golfer's torso for assisting him in observing his own torso position while in address posture, end of backswing posture, end of forward swing posture, for improving his golf swing, said device comprising;

(a) a support body member with a semi-circular shaped top surface with opposite ends;

an engaging means for holding said member's top surface in a perpendicularly outward orientation with respect to the golfer's torso and in a substantially horizontal orientation with respect to the ground;

a positioning means for aligning the centerline of said member adjacent with the approximate front centerline of the golfer's torso, whereby in operable position its circular portion protrudes outward the golfer's body; and the circular portion of said member having blunt edges thereby providing a safety configuration for said device, whereby the golfer may make a golf stroke safely when said device is operably secured properly to his torso.

2. A body-engaging golf device as recited in claim 1, further comprising:

said top surface of said member includes a centerline which is equi-distant from said opposite ends of said semi-circular shaped top, multiple spaced apart lines parallel to said centerline, a line perpendicular to said centerline;

whereby in operable position said lines may be used by the golfer to assist him in observing, the alignment of the front centerline of his torso position relative to the ball, club, and hands while in address posture, and define a fixed perpendicular line of direction to the centerline.

3. A body-engaging golf device as recited in claim 2, further comprising:

(a) a lightweight pointer element operably fastened with said member and extending outwardly therefrom; said pointer element having a longitudinal axis with opposite ends;

(b) said member comprising a fastening means for holding said pointer element so as its longitudinal axis being located in an approximate fixed parallel line of direction as said fixed perpendicular line of direction.

4. A body-engaging golf device as recited in claim 2, further comprising:

(a) a stem element consisting essentially of two pieces of elongated self-mating flexible material with opposite ends, having longitudinal axis, being sufficiently ridged to approximately support its own weight when operably attached by an end to said supporting member, and whereby operably the stem's length may be adjusted by mating overlappingly in its elongated direction a first piece with a second piece;

(b) said support member further comprises patches of self-mating material secured adjacent the circular portion of said member for cooperatively attaching with said stem element:

(c) whereby operably with stem attached said member thereto, the golfer may adjust length suitably for a specific club in address posture, flex stem element in desired line of direction so as adjacent the terminating end of that club, whereby assisting him in observing his own torso position's length measure with the end of that club handle; thereby assisting him in observing the same length measure between his torso position and end of club handle for repeated swings with the same club.

5. A body-engaging golf device as recited in claim 1, further comprising:

said member's operable visible color being approximately white, with said operably visible color of said fixed lines of said top surface being a visually contrasting color approximately black;

whereby operably said device being functionally useful for a plurality of visual circumstances.

6. A body-engaging golf device as recited in claim 1, further comprising:

an unobstructed sighting through-hole completely through said support member with its approximately center in alignment with said centerline of said support member;

whereby operably, located relative said member so as the golfer may use said sighting through-hole for assisting him in defining his own vertical torso position while in address posture, end of backswing posture, end of forward swing posture.

* * * * *